United States Patent [19]

Okamoto et al.

[11] 4,116,028

[45] Sep. 26, 1978

[54] ROLLING MILL

[75] Inventors: Toyohiko Okamoto, Toyonaka; Yoshisuke Misaka, Takarazuka; Motoo Asakawa, Minoo, all of Japan

[73] Assignee: Sumitomo Metal Industries, Ltd., Osaka, Japan

[21] Appl. No.: 816,734

[22] Filed: Jul. 18, 1977

Related U.S. Application Data

[63] Continuation-in-part of Ser. No. 738,061, Nov. 2, 1976, abandoned.

[51] Int. Cl.[2] ..... B21B 37/06

[52] U.S. Cl. ..... 72/21; 72/237

[58] Field of Search ..... 72/21, 6, 35, 205, 237, 72/238, 245

[56] References Cited

U.S. PATENT DOCUMENTS

| | | | |
|---|---|---|---|
| 3,375,688 | 4/1968 | Taylor | 72/21 |
| 3,818,742 | 6/1974 | Maltby et al. | 72/237 X |

FOREIGN PATENT DOCUMENTS

| | | | |
|---|---|---|---|
| 968,271 | 3/1958 | Fed. Rep. of Germany | 72/21 |
| 2,220,835 | 11/1972 | Fed. Rep. of Germany | 72/21 |

*Primary Examiner*—Milton S. Mehr

*Attorney, Agent, or Firm*—Fleit & Jacobson

[57] ABSTRACT

A continuous rolling mill including roll stands arranged in series, each of which has a pair of work rolls and roll chocks for supporting them respectively. One of the roll chocks is mounted on the frame of the roll stand to be movable in a direction parallel to the direction of path of the workpiece. A load sensing rod is provided to contact at its one end with the roll chock and to be thrusted through the roll chock by tensile or compression force occurring when the workpiece is being captured by the pair of rolls. The load sensing rod is hydraulically supported under a predetermined pressure so that the rod is shifted under an excessive load. The movement of the sensing rod is transduced to an electric signal representing the force for control of the mill.

20 Claims, 11 Drawing Figures

ROLLING MILL

CROSS-REFERENCE TO RELATED APPLICATION

This application is a continuation-in-part of co-pending United States Application Ser. No. 738,061, filed Nov. 2, 1976, entitled "ROLLING MILL", now abandoned.

The present invention relates to rolling mills including a plurality of roll stands arranged in series. More particularly, the present invention relates to means for measuring forces prevailing in materials or workpieces which extend between two adjacent roll stands.

During the rolling operation of a multistand rolling mill, if excessive force acts on a workpiece between a given pair of stands of the rolling mill, the workpiece will tend to bow between the pair of stands and in an extreme case to deflect from the pass line of the rolling mill. On the other hand, if excessive tension acts on the workpiece between the pair of stands, the workpiece will tend to slip at the roll nip. In an extreme case, the workpiece will neck down or decrease in width and in thickness, and will often break. Variations in the inter-stand compressive and tensile force will cause trouble in the rolling mill operation and have detrimental effects on the rolled product gauge or shape.

In order to eliminate such inconvenience in the rolling operation, it has heretofore been known to be necessary to perform continuous measurement of forces in the workpiece between adjacent roll stands so that the rotating speeds of the rolls in such roll stands can be controlled in accordance with the results of the measurement so as to ceaselessly maintain the inter-stand force of the workpiece between the adjacent roll stands at a desired value. For this purpose, conventionally, a looper has been provided between a given pair of roll stands for detecting the amount of deflection of the workpiece from a standard height. The amount of deflection is converted into the value of a force acting in the material or workpiece being rolled. The looper was very effective in measuring the force acting in the material being rolled in the case of a very thin material such as a strip steel. However, when the materials being rolled are of such thick gauges that loops cannot or can hardly be formed between roll stands, the looper could not be used. In the case of such thick materials, therefore, the values of forces acting in the materials being rolled have been obtained through calculation based on the change in roll driving current in a specific roll stand when the leading end of the workpiece is being captured by the next roll stand. A change in roll nip pressure in said specific roll stand may additionally be used in such calculation of the force in the workpiece.

However, such known method is disadvantageous since the results of measurement are often affected by the temperature and gauge of the material being rolled and by such operating conditions as acceleration and deceleration of the roll driving motor. Further, it is difficult to use the method for controlling the force in the workpiece between two adjacent roll stands during rolling operation. Particularly, it is extremely difficult through this method to attain stress-free control of the material between two adjacent roll stands during continuous rolling operation.

In the U.S. Pat. No. 3,290,912 issued on Dec. 13, 1966 to Warren Reid, there is disclosed a rolling mill in which tensile or compressive force in a rolling material between two adjacent roll stands can be continuously measured during rolling operation so that the force in the rolled material can be controlled as described. According to the teachings of the patent, force sensing transducers are mounted in each stand in such a manner that they sense and measure the horizontal forces acting between roll chocks and framemembers in the stand. However, in the arrangement as taught by the patent, difficulties may be encountered in removing and reinstalling the roll assemblies on the frame members because the force sensing transducers are disposed between the frame members and the work roll chocks and they may interfere with the roll assemblies during the operation of such removal and reinstallation. Further, in this patent, there is no means for protecting the load measuring device from failure under an excessive load.

The U.S. Pat. No. 3,214,970 issued on Nov. 2, 1965 to Rune Flinth discloses a rolling mill for wire products wherein tensile forces in wires are continuously measured. According to the teaching of the patent, each roll stand is supported by resilient members and horizontal thrust forces on the roll stand are measured by pressure sensitive measuring means. However, the proposal in this patent will be limited to applications to rolling mills for thin products such as wires and cannot readily be embodied in rolling mills for thick products since roll stands must be resiliently supported.

In the U.S. Pat. No. 3,375,688 issued on Apr. 2, 1968 to Louis H. Taylor there is disclosed an apparatus for rolling metal strips and sheets which includes a work roll too small to be driven through its neck. In the apparatus disclosed in this patent, sensing means are arranged very close to the small diameter work roll so as to directly detect deflection of the work roll. Thus, the deflection of the small diameter work roll can be detected with a relatively high degree of accuracy. However, mounting and demounting of the sensing means is troublesome because the sensing means and its piping or wiring must be located adjacent to the small diameter work roll within the stand housing. In addition, the operation of mounting the sensing means requires careful attention because the sensing means must be mounted to leave a very small gap between the sensing means and the small diameter work roll. Furthermore, if the workpiece being rolled is bowed during rolling operation, the sensing means would be broken by the bowed workpiece, because the sensing means is to close to the pass line.

The U.S. Pat. No. 3,818,742 issued on June 25, 1974 to Jack Maltby et al. discloses a cantilever rod or bar rolling mill having a pair of roll chocks each of which supports one work roll. Each roll chock has loading means disposed in a recess formed in one side surfce thereof and sensing means located in another recess provided in the opposite side surface thereof. In use, the loading means is actuated so that the sensing means is preloaded to detect variation in the horizontal force acting on the work roll. In this rolling mill, however, the roll chock and the sensing means cannot be separatly assembled into or disassembled from the rolling stand housing because the roll check must be assembled into the stand housing after the sensing means is mounted on the roll chock and because the sensing means must be removed from the roll chock after the roll chock is removed from the stand housing. In addition, electrical cables extending to the sensing means must be housed in a very small space inside of the roll stand housing. Thus, maintenance and replacement operations are troublesome and timeconsuming. Furthermore, the sensing means used in this rolling mill has no means for protecting the sensing means from being broken by an excessive load.

It is therefore an object of the present invention to provide rolling mills having improved means for measuring forces in workpieces which are being rolled.

Another object of the present invention is to provide means for continuously measuring forces in workpieces being rolled in rolling mills.

A further object of the present invention is to provide means for measuring forces in workpieces in rolling mills with simple and effective means for preventing excessive load from being imposed on the force measuring means.

A still further object of the present invention is to provide means for measuring force in rolling mills which does not interfere with roll assemblies during operation of removal and reinstallation of the roll assemblies and which is not precluded from being assembled into and disassembled from the roll stand by the roll assemblies.

A still further object of the present invention is to provide rolling mills having a tension and compression force measuring means which is free from the aforementioned drawbacks of the known arrangements.

According to the present invention in order to accomplish the above and other objects, the rolling mill includes a plurality of roll stands, each having a frame and roll chock means for supporting the associated work rolls, and force measuring means provided in at least one of the roll stands. In the roll stand provided with the force measuring means, one of the roll chock means is adapted to be movable within a limited extent parallel to the rolling direction. A load sensing rod is provided so as to extend parallel to the direction of movement of the roll chock means through or outside the frame and is in contact at one end with the roll chock means. The load sensing rod is associated with transducer means which is mounted in such a position that it is subjected to a pressure transmitted thereto from the associated roll chock means through the load sensing rod. Means is further provided for effecting axial movement of the rod so that it is projected or extended into contact with the associated roll chock means and retracted away from the roll chock means and retracted away from the roll chock means. Thus, when it is desired to remove the roll chock means from the frame of the roll stand together with the rolls mounted thereon, the load sensing rod can be retracted into a position that it does not interfere with the roll chock means. Hydraulic means is further provided for providing a support for the load detecting rod under a predetermined hydraulic pressure, so that the rod is shifted under an excessive load to prevent an excessive force from being transmitted to the transducer means.

According to one mode of the present invention, the load sensing rod is, at the other end, secured to or integrally formed with a piston which is reciprocatingly movable in a cylinder. The cylinder is in turn slidably received in a casing which is axially movable and provided with means for effecting such axial movement so that the load sensing device can be bodily moved toward and away from the roll chock. The transducer means may be in the form of a load cell and is disposed in the casing in such a manner that it is subjected to a pressure applied thereto through the cylinder. The piston is spring-biased to the retracted position and means is provided for introducing hydraulic pressure into the cylinder so that the piston is hydraulically locked with respect to the cylinder at the extended position. Thus, in operation, hydraulic pressure is introduced into the cylinder with the casing at the fully retracted position so as to lock the piston with respect to the cylinder. Thereafter, the casing is axially moved to advance the load sensing rod toward the roll chock until it contacts the roll chock with an appropriated pressure.

In a further and more preferable mode of the present invention, the transducer means is mounted between the load sensing rod and a piston rod on a piston which is reciprocatingly movable in a cylinder between an extended position and a retracted position. Means is provided for moving the cylinder in the axial direction and holding it at a desired position. The position is spring-biased toward the retracted position and there is provided means for introducing hydraulic pressure into the cylinder so as to hydraulically lock the piston with respect to the cylinder at the extended position. The arrangement is advantageous over the previously described mode of arrangement of the present invention in that the measurement is not affected by the friction which may be produced due to the sliding movement of the cylinder.

The above and other objects and features of the present invention will become apparent from the following descriptions of preferred embodiments with reference to the accompanying drawings, in which.

Figure 1:
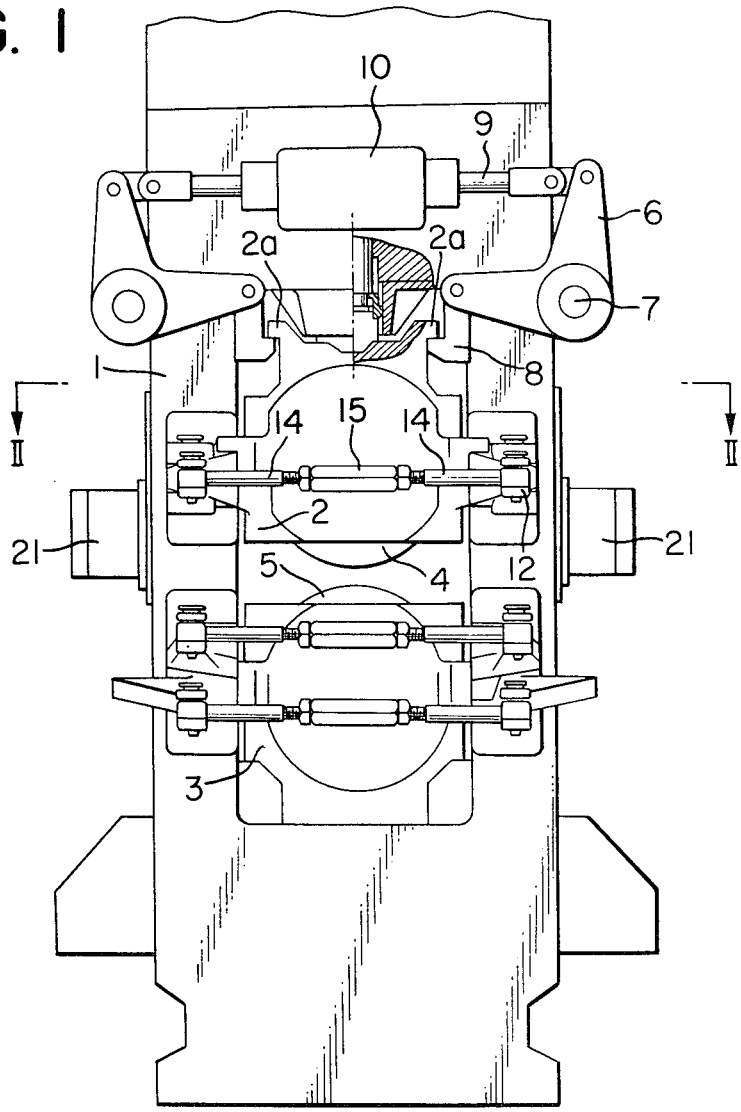
FIG. 1 is a partially cut-away side elevational view of a horizontal roll stand embodying the features of the present invention.

Referring to the drawings, particularly to FIGS. 1 through 4, there is shown a roll stand of the horizontal type which includes a frame 1 and upper and lower roll chocks 2 and 3 for supporting upper and a lower work rolls 4 and 5, respectively, at the opposide ends thereof. In this embodiment, the lower roll chocks 3 are mounted on the frame 1 in a manner conventional in the art.

Each upper roll chock 2 is resiliently suspended by a mechanism including a pair of bell-crank members 6 mounted on the frame 1 rotatably about horizontal shafts 7. Each bell-crank member 6 has, at one of its ends, a hook member 8 which engages a cooperating flange 2a formed on the upper roll chock 2 at the upper portion thereof. The other end of each bell-brank member 6 is connected through a rod 9 with a spring assembly 10 so that the upper roll chock 2 is resiliently forced upwardly under the action of the spring assembly 10. FIG. 1 shows one such mechanism provided at one axial end of the upper roll 4. However, it should be noted that a similar mechanism is also provided at the other axial end.

Figure 2:
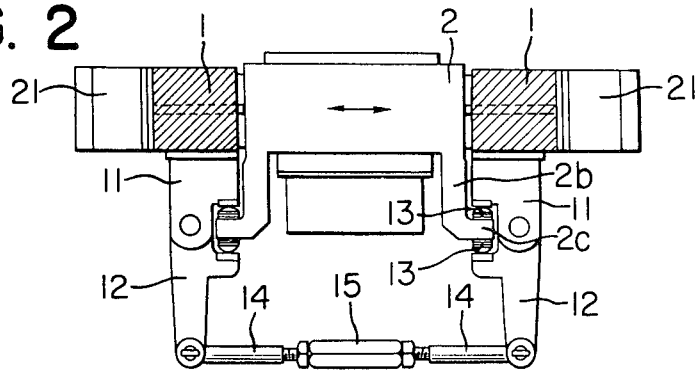
FIG. 2 is a horizontal sectional view taken substantially along the line II—II in FIG. 1.

The upper roll chock 2 is mounted in the frame 1 for movement within a limited extent parallel to the direction of the path of the workpiece. For this purpose, the roll chock 2 is located in the frame 1 with clearances at the forward and rearward sides. Furthermore, as shown in FIG. 2, the upper roll chock 2 is formed with a pair of L-shaped arms 2b having radilly outwardly directed ends 2c which are positioned between bracket members 11 mounted on the frame 1 and clamping members 12 with interposition of metal pads or spacers 13. Recommendable material for such pads 13 is a laminated composite comprising a plurality of alternate metal and plastic laminae, as disclosed in United States Patent Application Ser. No. 632,685, filed 1975 Nov. 17th, assigned to Morgan Const. Co. Tie rods 14 and a turnbuckle 15 are provided for maintaining the clamping members 12 in operative positions. In this mechanism, the metal pads 13 serve to constrain the associated roll chock 2 against movement in the direction of axis of the roll but allow it to move in the direction parallel to the movement of the workpiece as shown by an arrow in FIG. 2.

Figure 4:
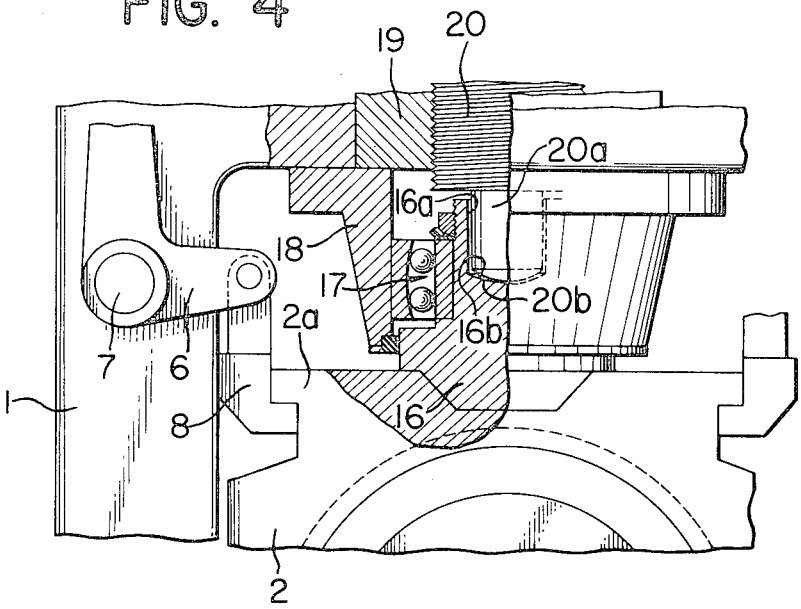
FIG. 4 is a sectional view showing the mechanism for suspending the upper roll chock.

Back-up pressure is applied to each of the upper roll chocks 2 through a mechanism shown in FIG. 4. The mechanism includes a thrust receiving member 16 placed on the top portion of the upper roll chock 2 and carrying a self-centering bearing 17 on its outer cylindrical surface. The frame 1 has a hollow cylindrical bracket member 18 which slidably supports the outer race of the bearing 17. An internally threaded member 19 is mounted on the frame 1 and a vertical thrust screw 20 engages the member 19 for adjusting the vertical position of the roll chock 2, thereby setting the gap between the rolls at a desired value. As is well known in the art, the thrust screw 20 withstands the force tending to separate the rolls 4 and 5, and applies downward rolling force to the workpiece through the roll chock 2 and the roll 4 when the workpiece is being rolled by the stand. The screw 20 is formed with an axial extension 20a having a part-spherical end 20b. The thrust receiving member 16 on the upper roll chock 2 is formed with a cylindrical bore 16a having a part-spherical bottom 16b. The extension 20a of the screw 20 is inserted into the bore 16a. The radius of the curvature of the bottom 16b of the bore 16 is greater than that of the end 20b on the screw extension 20a so that the extension 20a makes point contact with the bottom 16b of the bore 16a at or in the vicinity of the center of the self-centering bearing 17. Thus, it will be understood that the mechanism is effective to set and support the roll chock 2 at a desired vertical position while allowing it to swing about the center of the bearing 17 in accordance with the reaction force applied thereto from the workpiece through the corresponding working roll.

Referring back to FIG. 1, it will be seen that there are provided a pair of load sensing devices 21 at the forward and rearward sides of the upper roll chock 2. Since the devices 21 have the same structures and the same functions, only one of them will hereinafter be described with reference to FIG. 3.

Figure 3:
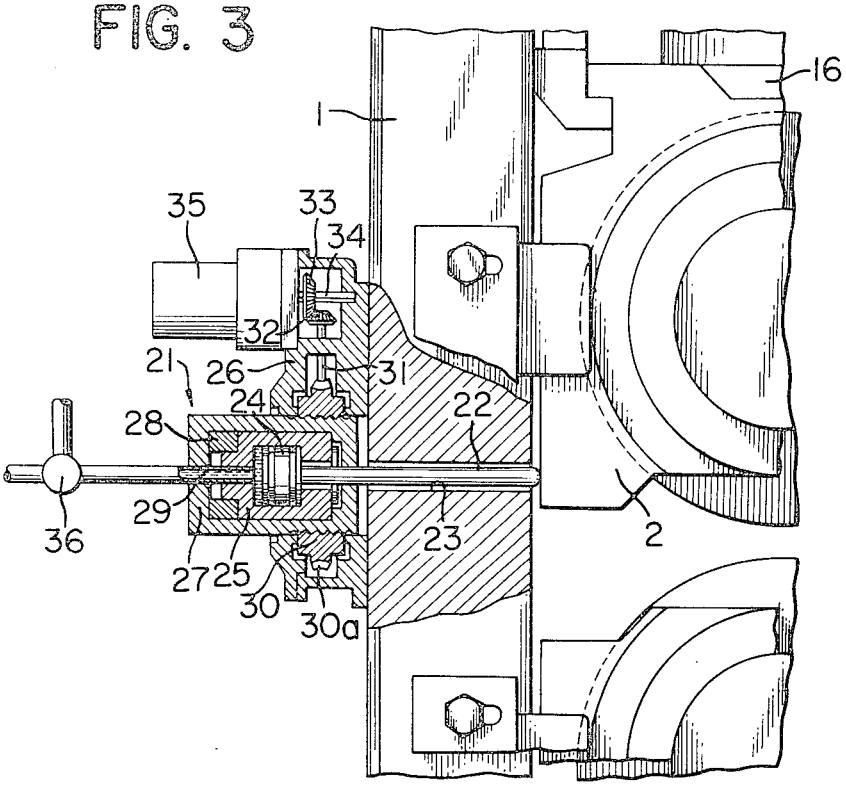
FIG. 3 is a sectional view showing details of the load measuring device in accordance with one embodiment of the present invention.

Referring now to FIG. 3, the load sensing device 21 includes a load sensing rod 22 extending in the direction parallel to the direction of the path of the workpiece through a hole 23 formed in the frame 1. One end of the rod 22 is adapted to contact with the upper roll chock 2 and the other end is secured to a position 24 which is reciprocatingly slidable in a cylinder 25.

A stationary housing 26 is mounted on the frame 1 and carries a cylindrical hollow casing 27 which is axially slidable but constrained against rotation. The cylinder 25 is axially slidably received in the casing 27. A load sensing transducer such as a load cell 28 is interposed between the inner end wall of the casing 27 and the end of the cylinder 25 opposite to the roll chock 2. The cylinder 25 is provided with a conduit 29 for introducing pressurized hydraulic fluid into the cylinder 25 at the side of the piston 24 opposite to the rod 22.

The casing 27 is formed with an external screw thread which is engaged with a ring nut member 30. The nut member 30 is provided at its outer surface with a worm wheel 30a which is in meshing engagement with a worm portion of a rotatable gear shaft 31. A bevel gear 32 is mounted on the free end of the gear shaft 31 and meshes with a bevel gear 33 on the output shaft 34 of an electric motor 35.

Thus, it will be seen in this arrangement that the load sensing rod 22 can be retracted by energizing the motor 35 and driving the casing 27 through the gears 32 and 33 and the worm mechanism 30a bodily toward the left. In this retracted position, the rod 22 does not interfere with the operation of removal and reinstallation of the upper chock 2.

In order to place the load sensing device 21 in the operative position, hydraulic pressure is at first introduced through the conduit 29 into the cylinder 25. Thus, the piston 24 is hydraulically locked with respect to the cylinder 25 at the extended position. Then, the motor 35 is energized to drive the casing toward right so that the rod 22 is projected through the frame 1 and brought into contact with the roll chock 2. In a rolling operation where the workpiece is being rolled simultaneously by at least two adjacent roll stands, the workpiece is subjected to tensile or compression force of a value depending upon the rolling conditions such as rolling speed, rolling reduction rate, etc. The rolls 4 and 5 upon capturing the workpiece at the nip thereof suffer a force, which is, in turn, transmitted to the roll chocks 2 and 3, causing a swinging movement of the upper roll chock 2. Thus, the load sensing rod 22 is subjected to an axial force which corresponds to the reaction force and is transmitted thereto from the roll chock 2. Since the piston 24 is hydraulically locked with respect to the cylinder 24, the force thus applied to the rod 22 is transmitted through the piston 24 and the cylinder 25 to the transducer 28. Thus, the transducer produces an electric signal which represents the tensile or compression force in the workpiece.

The hydraulic conduit 29 is provided with a safety pressure relief device 36. Therefore, if the reaction force on the roll chock 2 exceeds a predetermined value, the piston 24 is allowed to move with respect to the cylinder 25. Thus, the load transducer 28 and other components in the load sensing device 21 are protected from damage under excessive load.

Figure 5:
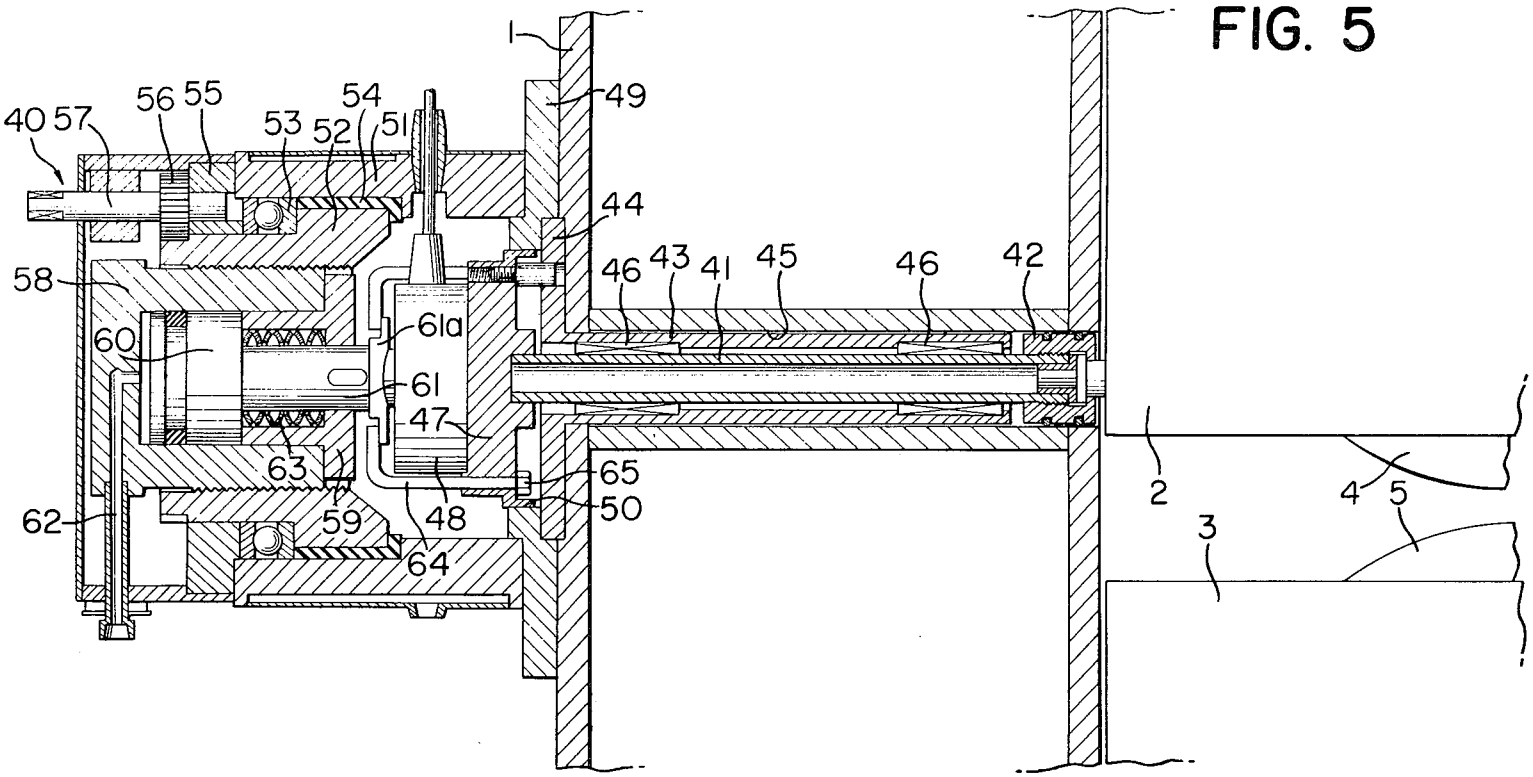
FIG. 5 is a sectional view similar to FIG. 3 but showing another embodiment of the present invention.

Referring now to FIG. 5, the numeral 40 indicates another embodiment of the load sensing device including a load sensing rod 41 having an end piece 42 adapted to be brought into contact with the upper roll chock 2. A sleeve member 43 having an end flange 44 is inserted into a hole 45 in the frame 1 and axially slidably receives the rod 41 through bearing 46.

The load sensing rod 41 have a disc 47 secured thereto at the end opposite to the end piece 42. The disc 47 carries a load transducer 48. On the frame 1, there is mounted a guide plate 49 which has a circular guide hole 50 and the transducer carrying disc 47 is slidably received in and guided by the hole 50 on the plate 49.

The plate 49 carries a cylindrical housing 51 in which rotatable member 52 is mounted through bearings 53 and 54. An annular retaining plate 55 is secured to an outer end of the housing 51 for maintaining the rotatable member 52 and the bearing 53 and 54 against axial movement. The rotatable member 52 is formed at an outer end with external gear teeth 52a which are in meshing engagement with a pinion 56. The pinion 56 is secured to a shaft 57 and driven by a suitable power source such as an electric motor (not shown).

Within the rotatable member 52, there is axially movably but non-rotatably disposed a hydraulic cylinder 58 having an end plate 59 which closes an open end of the cylinder 58. A piston 60 is slidably disposed in the cylinder 58 and has a piston rod 61 extending through the end plate 59. A hydraulic conduit 62 is provided for supplying pressurized hydraulic fluid into the cylinder 58 at the side of the piston 60 opposite to the piston rod 61. Between the piston 60 and the end plate 59, there is disposed a spring 63 which biases the piston to the retracted position, that is, toward left in FIG. 5.

The rotatable member 52 is formed on its inner surface with a internal screw which is in engagement with a corresponding external screw provided on the hydraulic cylinder 58, so that the cylinder 58 is moved in the axial direction as the rotatable member 52 is rotated through the pinion 56.

The piston rod 61 has an end flange 61a at its outer end which is adapted to engage with the load transducer 48. The end flange 61a on the piston rod 61 is maintained in contact with the transducer 48 through a plurality of L-shaped tie members 64 which are attached to the disc member 47 by nuts 65.

In this arrangement, when the hydraulic pressure is released from the cylinder 58, the piston 60 is formed into the retracted position under the influence of the spring 63. Thus, the load sensing rod 41 is also retracted through the tie members 64 and the disc 47. The rod 41 can further be retracted by bodily displacing the hydraulic cylinder 58 toward left through rotation of the member 52.

In operation, hydraulic pressure is introduced into the cylinder 58 so as to shift the piston 60 to the extended position against the action of the spring 63. As in the previous embodiment, the piston 60 is hydraulically locked in this position with respect to the cylinder 58. Then, the pinion 56 is driven by the motor to shift the cylinder 58 axially rightwardly through the rotatable member 52 until the end piece 42 on the rod 41 is brought into contact with the roll chock 2.

The arrangement of this embodiment is advantageous over the previous embodiment since the load transducer 48 is located between the load sensing rod 41 and the piston 60 so that the results of measurement are not affected by a frictional force which may be produced due to a sliding movement of the hydraulic cylinder.

Figure 6:
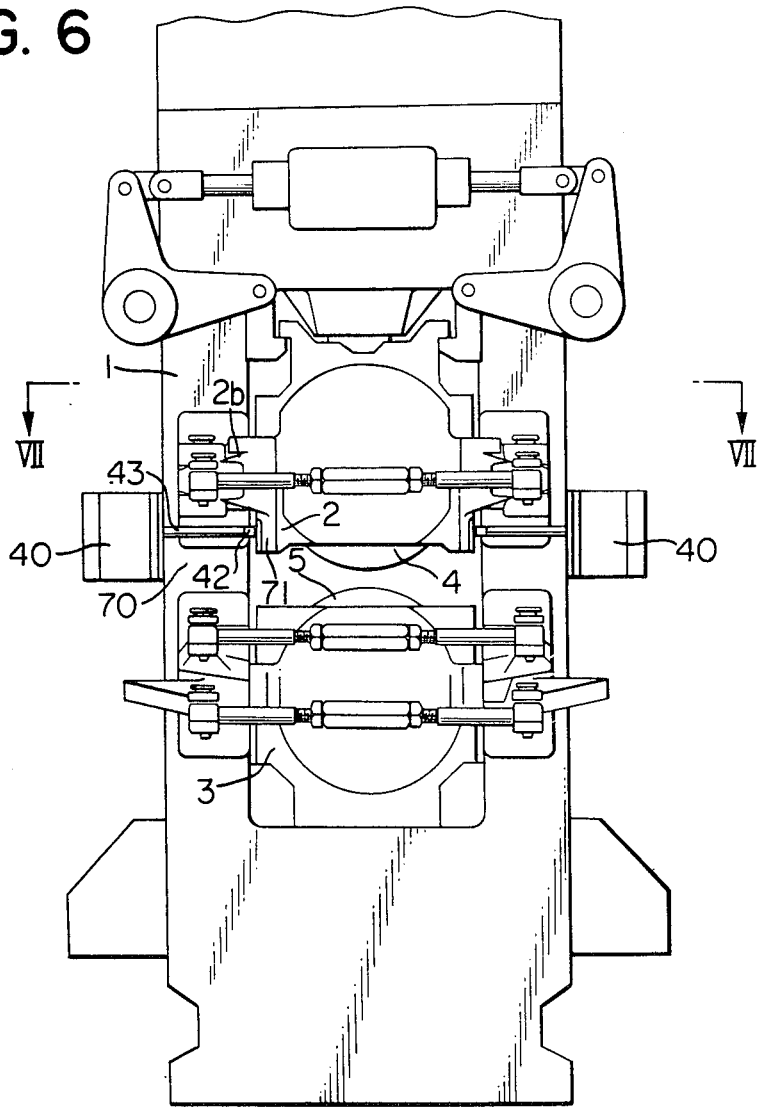
FIG. 6 is a view similar to FIG. 1 but showing another manner of mounting the load sensing device to a roll stand.
Figure 7:
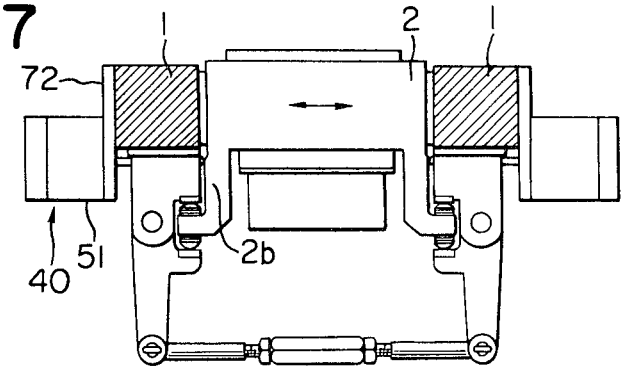
FIG. 7 is a horizontal sectional view taken substantially along the line VII—VII in FIG. 6.

The load sensing device 40 as mentioned above may be mounted on the roll stand frame 1 as shown in FIGS. 6 and 7. In this case, the sleeve member 43 of the load sensing device 40 is located to extend along and outside of the outer surface 70 of the frame 1 parallel to and remote from the pass line so that the end piece 42 of the sensing rod 41 can be brought into contact with an outer extending portion 71 of the upper roll chock 2 below the L-shaped arm **2*b*, as shown in FIG. 6. The sleeve member 43 may be secured to the frame by a suitable fastening means (not shown). The end flange 44 of the sleeve member 43 and the guide plate 49 are mounted on an auxiliary plate 72, which is in turn fixed to the outside of the frame opposite to the upper roll chock 2, as shown in FIG. 7. With this arrangement, there is no need for provision of a hole in the frame for insertion of the sleeve member 43**, and therefore, the load sensing device is easily applicable to the conventional rolling stands without substantial modification of the stands.

Figure 8:
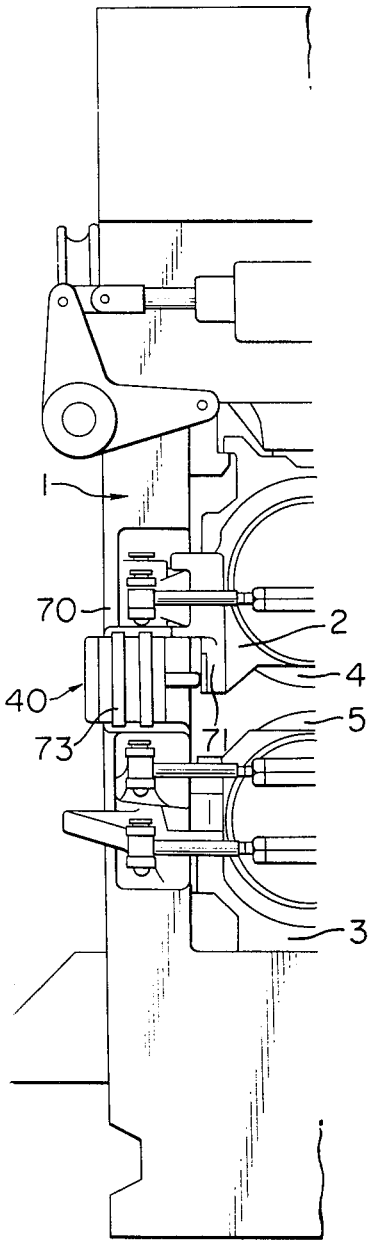
FIG. 8 is a partial side elevational view of a roll stand showing still another manner of mounting the load sensing device to the roll stand.

Alternatively, the load sensing device 40 can be mounted on the outer surface 70 of the frame 1 by means of suitable fixture means such as bands 73 and shaped metals, as shown in FIG. 8. In this case, the sleeve member 43 and the sensing rod 41 are shorter than in the arrangement shown in FIGS. 6 and 7. In addition, it is not necessary to support the sleeve member 43. It should be noted that the load sensing device 21 as shown in FIG. 3 can be mounted on the frame 1 in a similar manner to that for the device 40 described with reference to FIGS. 6 through 8.

Figure 9:
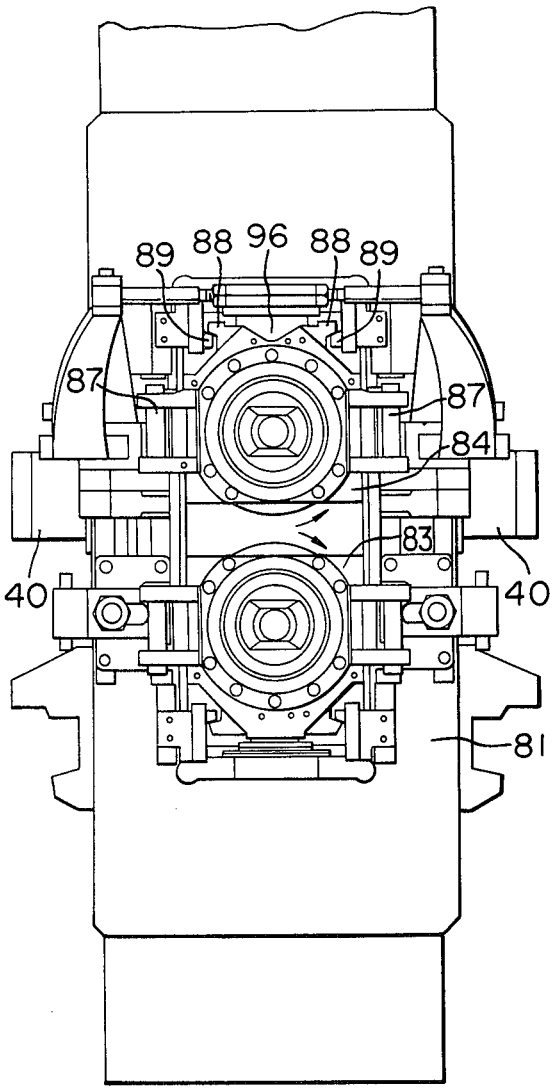
FIG. 9 is a top view of a vertical roll stand embodying the features of this invention.
Figure 10:
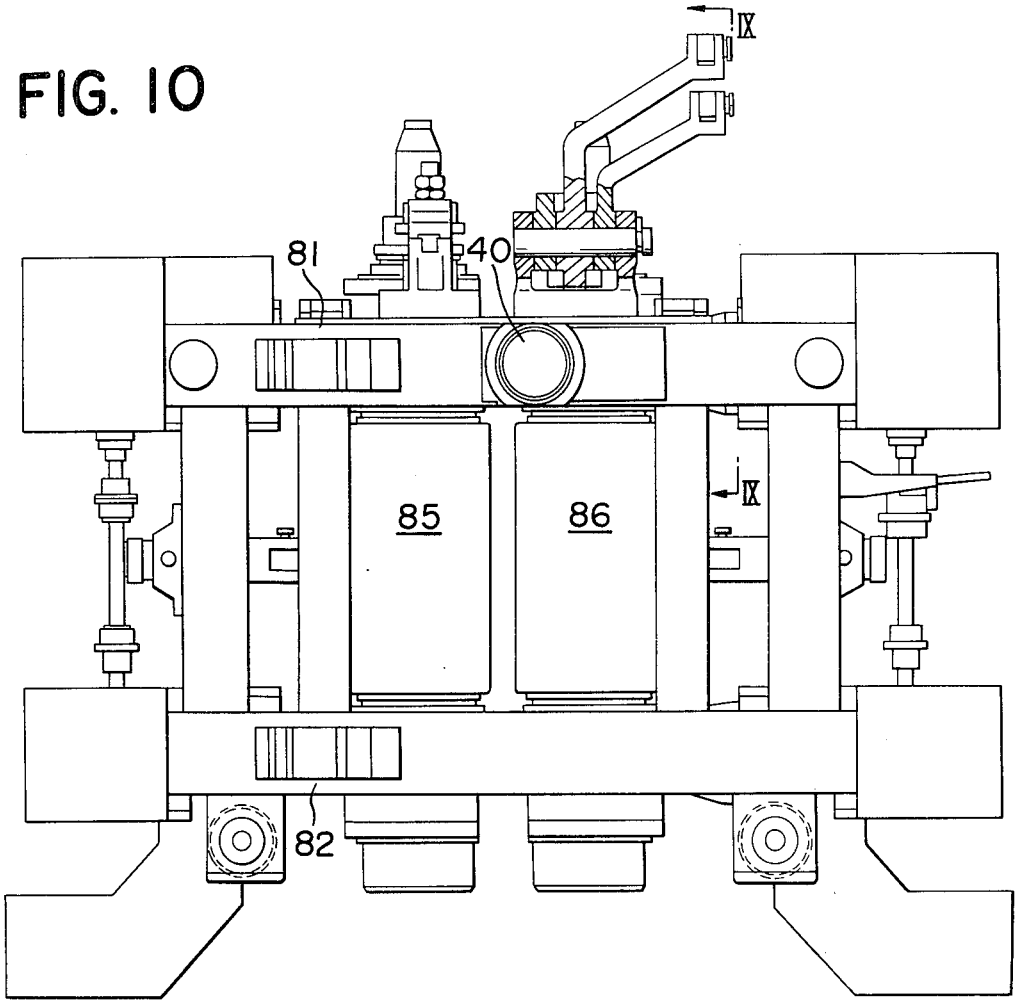
FIG. 10 is a front view of the roll stand shown in FIG. 9.
Figure 11:
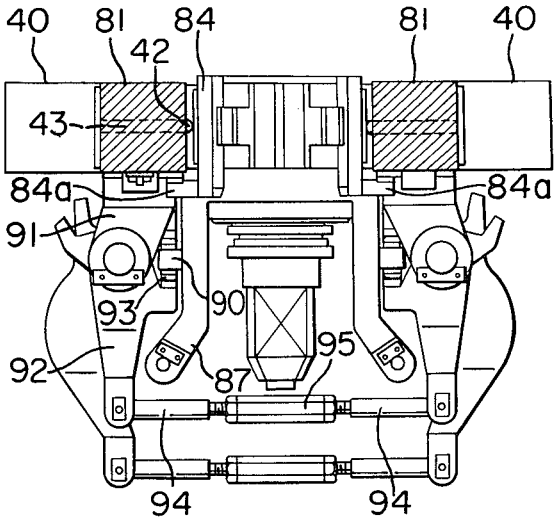
FIG. 11 is a vertical sectional view taken substantially along the line XI—XI in FIG. 10.

Now, referring to FIGS. 9 through 11, there is shown a roll stand of the vertical type which incorporates therein the same load sensing device as that shown in FIG. 5. This roll stand includes upper and lower frames 81 and 82, the roll chocks 83 and 84 for supporting drive side and work side work rolls 85 and 86, respectively, at their opposite ends. In this embodiment, the drive side roll chocks 83 are mounted on the frames 81 and 82 in the conventional manner. On the other hand, the work side roll chocks are mounted on the frames 81 and 82 to be movable within a limited extent in the direction parallel to the pass line, in a manner similar to that of the upper roll chock 2 shown in FIGS. 1 through 4.

To be brief, the work side roll chock 84 has a pair of hooks 87 for assembly and disassembly from the roll stand by suitable hoisting means (now shown). The roll chock 84 also has a pair of side flanges 88 formed at the side thereof opposite to the exposed portion of the work roll and adapted to engage, respectively, a pair of roll balance beams 89 formed on the frame. Further, the roll chock 84 includes a pair of outwardly extending portions 84a which are adapted to ride on the outer surface of the frame 81. The hook 87 has an outwardly extending portion 90 formed at an intermediate portion thereof and adapted to be interposed between a bracket member 91 and a clamping member 92 with interposition of pads or spacers 93. Tie rods 94 and a turnbuckle 95 are provided for maintaining the clamping members 92 in operative positions. The pads 93 serve to constrain the associated roll chock 84 against movement in the direction of axis of the roll but allows it to move in the direction parallel to the movement of the workpiece.

The work side roll chock 84 are adapted to be applied with back-up pressure from a mechanism 96 which has a similar construction to that of the back-up mechanism as shown in FIG. 4. The drive side roll chock 83 also has similar back-up mechanism.

The upper frame 81 has a pair of the same load sensing devices as the load sensing device 40 as shown in FIG. 5, one of which is mounted on the delivery side of the upper frame 81 and the other of which is mounted on the entry side of the upper frame. These load sensing devices 40 are mounted to the upper frame 81 in the same manner. Namely, each load sensing device 40 is mounted on the outer face of the upper frame 81 opposite to the roll chock 84 in such a manner that its sleeve member 43 and hence its sensing rod 41 extend through a hole formed in the upper frame 81 in the direction parallel to the direction of the pass line so that the end piece 42 of the load sensing device 40 can be brought into contact with the roll chock 84, in similar manner to that shown in FIG. 5. The manner of mounting the load sensing device 40 on the upper frame 81 is quite similar in all details to the manner of mounting the device 40 on the horizontal type roll stand as shown in and described with reference to FIG. 5. Operation is also totally similar to that described with reference to FIG. 5. Therefore, detailed explanation will be omitted here. It should be noted that the load sensing devices 40 may be mounted on the lower frame 82 and that they may be mounted in similar manner to that shown in FIGS. 6 through 8. It should also be noted that the load sensing device as shown in FIG. 3 can be also applied in the vertical roll stand.

The invention has thus been shown and described with reference to specific embodiments, however, it should be noted that the invention is in no way limited to the details of the illustrated structures but changes and modifications may be made within the scope of the appended claims. For example, when it is desired to measure either one of compression and tensile forces in the workpiece, only one load measuring device may be provided on the appropriate side of the movable roll chock. Further, such measuring device or devices may be provided in association with the lower roll chock or drive side roll chock.

We claim:

1. Continuous rolling mill including: a plurality of roll stands arranged in series, each of said roll stands comprising a frame, at least a pair of work rolls, roll chock means for supporting respectively said work rolls, one of said work chock means being mounted on the frame for movement together with the corresponding roll in a direction perpendicular to the axis of said roll, and means for adjusting the position of said movably mounted chock means to thereby set the gap between the associated work roll and the opposite work roll at a desired value; and force measuring means provided in at least one of the roll stands for measuring a force in a workpiece extending between said one roll stand and an adjacent one of the roll stands, said force measuring means comprising means for mounting at least one of said work roll chock means on the frame for movement within a limited extent in a direction parallel to the direction of the path of the workpiece, load sensing rod means extending in a direction substantially parallel to the direction of the path of the workpiece and adapted to contact at one end with said chock means movable in the direction parallel to the direction of the path of the workpiece, transducer means positioned outside of the frame of said one roll stand and associated with said load sensing rod means so as to receive a force axially transmitted through said rod means for providing an electric signal representing the force, means for effecting axial movement of said rod means together with said transducer means into and out of contact with the movable roll chock means, and hydraulic means for supporting said rod means under a predetermined hydraulic pressure so that when a load exceeds said predetermined pressure said rod means is shifted to prevent such excessive load from being applied to said transducer means.

2. Rolling mill in accordance with claim 1 wherein said sensng rod means extends through a hole formed in the frame of said one roll stand to contact at one end with said chock means movable in the direction parallel to the direction of the path of the workpiece.

3. Rolling mill in accordance with claim 1 wherein said sensing rod means extends over the outside of the frame of said one roll stand opposite to the path line of the workpiece.

4. Rolling mill in accordance with claim 1 wherein said hydraulic means includes hydraulic cylinder means and piston means disposed in said cylinder means, said piston means being connected with said load sensing rod means, said cylinder means being axially slidably received in casing means which is adapted to be driven by said axial movement means, said transducer means being disposed in said casing means so as to receive a pressure through said hydraulic cylinder means from said load sensing means.

5. Rolling mill in accordance with claim 1 wherein said hydraulic means includes hydraulic cylinder means and piston means disposed in said cylinder means, means being provided for connecting said piston means and said load sensing rod means with said transducer means interposed therebetween, said axial movement means being in engagement with said hydraulic cylinder means.

6. Rolling mill in accordance with claim 5 wherein said axial movement means includes a rotatable member disposed around the hydraulic cylinder means and in screw engagement therewith, and means for rotating said rotatable member.

7. Rolling mill in accordance with claim 1 wherein at least one of said roll stands is of the horizontal type which comprises a frame, upper and lower rolls, upper and lower chock means for supporting respectively the upper and lower rolls, said upper chock means being mounted on the frame for vertical movement together with said upper roll, and said roll gap setting means abutting against the upper chock means and withstanding the force tending to move the upper roll and the upper chock means upwardly.

8. Rolling mill in accordance with claim 7 wherein said upper roll chock means is mounted for swinging movement about a point above an axis of the upper roll to provide said movement parallel to the path of the workpiece, and said roll gap setting means including a thrust member which makes point contact with said roll chock means substantially at said point.

9. Rolling mill in accordance with claim 8 wherein said upper roll chock means is mounted by self-contering bearing means which allows said swinging movement.

10. Rolling mill in accordance with claim 8 wherein said thrust member has a part-spherical lower end which engages with a part-spherical seat on the upper roll chock means, the part-spherical configuration of said seat having a radius of curvature greater than that of the lower end of the thrust member.

11. Rolling mill in accordance with claim 1 wherein said one roll chock means is located in the frame with clearances at the forward and rearward sides thereof and mounted on the frame through means adapted to constrain the movement in the axis direction of the work roll but to allow the movement parallel to the path of the workpiece.

12. Rolling mill in accordance with claim 11 wherein said means for constraining the movement in the axis direction but allowing the movement parallel to the path of the workpiece is a laminated composite comprising a plurality of alternate metal and plastic laminae.

13. Rolling mill in accordance with claim 1 wherein at least one of said roll stands is of the vertical type which comprises upper and lower frames, drive side and work side vertical work rolls, and roll chock means for supporting said drive side and work side work rolls, respectively, said work side roll chock means being mounted on said frames to be movable within a limited extent in the direction parallel to the direction of the path of the workpiece, said force measuring means being mounted on one of said frames in such a manner that the load sensing rod means thereof can be brought at one end into contact with said work side roll chock means.

14. Load sensing device for measurement of a force in a workpiece extending between adjacent two roll stands each of which includes a frame, at least a pair of work rolls and work roll chocks for supporting the work rolls respectively, comprising a housing adapted to be mounted on the frame of one of the adjacent two roll stand, load sensing rod means having one end adapted to be contacted with one of the work roll chocks of said one roll stand, transducer means associated with said load sensing rod means so as to receive a force axially transmitted through said rod means for generating an electric signal representing the force, means for effecting axial movement of said rod means into and out of contact with said one work roll, and hydraulic means including hydraulic cylinder means and piston means disposed in said cylinder means, said piston means being adapted to support said rod means under a predetermined hydraulic pressure so that when a force acting on through said rod means exceeds said predetermined pressure, said piston moves to prevent such an excessive force from being applied to said transducer means.

15. Load sensing device in accordance with claim 14 wherein said cylinder means is provided with conduit means for introducing pressurized hydraulic fluid into said cylinder means at the side of said piston means opposite to said rod means so that said piston means is hydraulically locked with respect to said cylinder means at its extended position.

16. Load sensing device in accordance with claim 15 wherein said piston means is directly connected with said load sensing rod means, said cylinder means being axially slidably received in casing means which is adapted to be driven by said axial movement means, said transducer means being disposed in said casing means so as to receive a pressure from said hydraulic cylinder means.

17. Load sensing device in accordance with claim 16 wherein said casing means is axially slidably but nonrotatably supported by said housing and wherein said axial movement means includes a ring nut member having an internal screw in mating engagement with an external screw provided on said casing means and an electric motor for rotating said ring nut member.

18. Load sensing device in accordance with claim 15 further including disc means secured at one side thereof to the other end of said load sensing rod means and carrying at the other side thereof said transducer means, and piston rod means having one end thereof secured to said piston means and the other end thereof adapted to engage with said transducer means.

19. Load sensing device in accordance with claim 18 wherein said axial movement means includes an intermediate member rotatably supported by said housing and having at its inner surface an internal screw in mating engagement with an outer screw provided on said cylinder means to allow said cylinder means to move axially, said rotatable member having external gear teeth formed at outer end thereof, and a rotatable shaft having a pinion in meshing engagement with said external gear teeth of said rotatable member.

20. Load sensing device in accordance with claim 18 wherein said cylinder means has an end plate for closing an open end of said cylinder means and spring means disposed between said piston means and said end plate so as to apply a biasing force to said piston means towards its retracted position.

* * * * *